United States Patent [19]

Baud et al.

[11] 4,069,121

[45] Jan. 17, 1978

[54] METHOD FOR PRODUCING MICROSCOPIC PASSAGES IN A SEMICONDUCTOR BODY FOR ELECTRON-MULTIPLICATION APPLICATIONS

[75] Inventors: Christian Baud; Yvan Raverdy; Henri Hougeot, all of Paris, France

[73] Assignee: Thomson-CSF, Paris, France

[21] Appl. No.: 698,224

[22] Filed: June 21, 1976

[30] Foreign Application Priority Data

June 27, 1975 France ..... 75 20393

[51] Int. Cl.[2] ..... C25F 3/12; C25F 3/14

[52] U.S. Cl. ..... 204/129.3; 204/129.55; 204/224 R

[58] Field of Search ..... 204/129.3, 224 R, 129.55

[56] References Cited

U.S. PATENT DOCUMENTS 3,265,599 8/1966 Soonpaa ..... 204/129.3

OTHER PUBLICATIONS

Arora et al., "A New Mesa-Etching Technique for Gallium Arsenide", J. Materials Sci. 8, (1973), p. 611.

*Primary Examiner*—John H. Mack
*Assistant Examiner*—D. R. Valentine
*Attorney, Agent, or Firm*—Roland Plottel

[57] ABSTRACT

A method for drilling microscopic passages in a semiconductor body.

The semiconductor 1 is incorporated into the anode of an electrolysis installation, one of its faces being in contact with the electrolyte 11 and the other containing a hole injection system. The holes migrate in the electric field from one face to the other; at the latter, dissolution of the semiconductor face in the electrolyte takes place. Gradually, passages are bored through the semiconductor along the trajectories of the holes. In the example, the holes are created photoelectrically in the gaps 2 between the opaque parts 4 applied to the transparent anode contact 3.

5 Claims, 3 Drawing Figures

Figure 1:
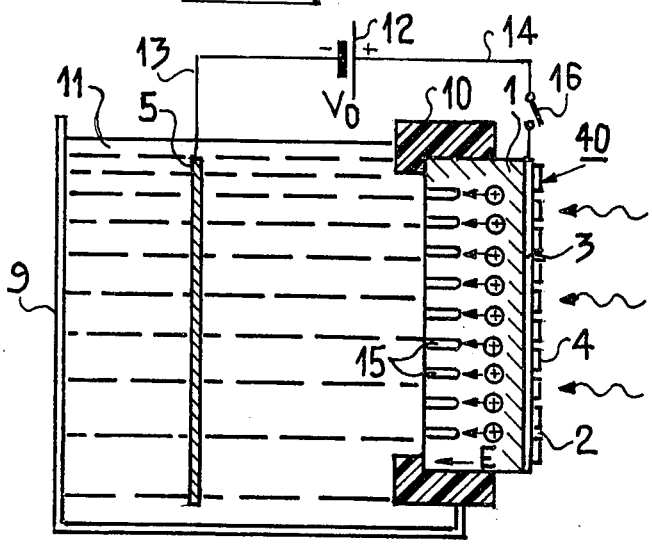

METHOD FOR PRODUCING MICROSCOPIC PASSAGES IN A SEMICONDUCTOR BODY FOR ELECTRON-MULTIPLICATION APPLICATIONS

The present invention relates to a method of production of microscopic channels in a semiconductor body.

It relates in particular to the drilling of microscopic channels which are designed for electron-multiplication purposes. It will be described in this context in order to provide a concrete notion of what is involved, although it should be clearly understood that this choice is in no way limitative of the scope of the invention which applies in a general way to the drilling of microscopic passages in semiconductor bodies whatever the application for which they are intended, their numbers, their arrangement, etc., and whether or not said passages are present in large numbers, located close to one another and distributed throughout the whole of the semiconductor for example, as in the case of the multiplier situation referred to earlier, or by contrast in small numbers, located at selected points in the semiconductor.

Those skilled in the art will be familiar with electron-multipliers and more particularly those in which multiplication of a beam of primary electrons is achieved through a series of secondary electron emissions taking place within a set of rectilinear passages, parallel to one another, arranged in a longitudinal electric field.

Multipliers of this kind and their applications to light amplifier devices have been described in various publications, in particular in U.S. Pat. No. 3,128,408 and U.S. Pat. No. 3,424,909.

In the latter Patent referred to, the passages in the multiplier are drilled in the body of a silicon diode biased in the reverse direction. This structure avoids certain of the drawbacks exhibited by prior art electron-multipliers of the kind specified in the text of the Patent in question. In particular, it avoids that of these drawbacks which is due to the difficulty in forming the conductive deposit on the internal wall of the passages. By contrast, it creates another difficulty, that of drilling accurately dimensioned passages of small diameter.

In the cited Patent, the drilling of these passages was performed using an electron beam or a laser beam or by chemical etching through a mask. These procedures had various drawbacks amongst which was the frequent destruction of the body due to local melting in the case of the first two procedures, or the greater or lesser degree of conicity in the hole produced by lateral enlargement during chemical etching across a mask, in the case of the latter procedure. The implementation of the method which forms the object of the present invention makes it possible to overcome these drawbacks.

The invention relates to preferably n-type semiconductors of high resistivity, that is to say ones having a low impurity content; these materials may either be semiconductors or semi-insulators or again compensated semiconductors; the content referred to corresponds in all cases to a number of free charge carriers less than or equal to $10^{12}$ per cubic centimetre.

In accordance with the invention, a small plate cut from a material of one of these types is provided upon one of its faces with a network of points arranged in a mosaic pattern for example, playing the part of "hole" injectors, whilst the other face is placed in contact with an electrolyte in which an electrode doing duty as cathode is immersed. A conductive element linking all the injector points constitutes the anode contact of the electrolytic installation thus created.

The electrolyte-semiconductor contact is such that a surface barrier forms there, which has the electrical properties of Schottky diodes obtained by placing a metal and a semiconductor in contact. In particular, the fundamental property of Schottky diodes, namely rectification of the current, is observed there. By biasing the electrolyte negatively in relation to the semiconductor with a direct voltage applied between the cathode and the electrode common to the hole injector points on that face of the semiconductor not in contact with the electrolyte, a space charge zone is created which extends through the thickness of the semiconductor from that of its faces in contact with the electrolyte. At a given thickness and for a given applied voltage this zone extends up to the neighbourhood of the opposite face in a sufficiently pure semiconductor material, that is to say a material having a free charge carrier density per cubic centimetre which is sufficiently low. An electric field perpendicular to the faces of the semiconductor small plate and extending over a major part of the thickness thereof, is created in this way so that any hole injected via the mosaic of injector points at that face not in contact with the electrolyte, after a possible slight initial diffusion, follows a rectilinear trajectory through the thickness of small plate and emerges in the electrolyte at a point which is the projection, on to that face which is in contact with the electrolyte, of the point which has produced the injection, on the other surface. At this point, dissolution of molecules of the material in question takes place. This dissolution takes place at the point of emergence of the hole on that face which is in contact with the electrolyte, so that at said face etching takes place reproducing the pattern of the injector points applied to the other face.

This kind of etching is applicable to any kind of pattern other than the aforesaid mosaic. It is particularly suitable for the drilling of microscopic passages for electron multiplication applications, in semiconductor plates.

From what has been said earlier, it is clear that etching is not possible unless the electric field extends over a sufficient distance from that face upon which the hole injector points are located, and at least up to a distance from the opposite surface which is less than the diffusion length of the holes in the semiconductor.

The advantage of the machining method described resides in the fact that the electrical and crystallographic qualities of the material are fully maintained during machining, and that no lateral etching of a kind which could flare the passages is possible, due to the fact that the injected holes follow the electric field perpendicular to the faces.

Figure 2:
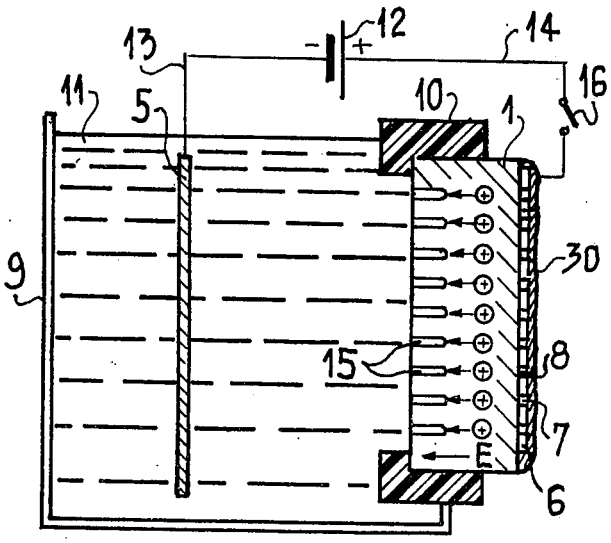
Figure 3:
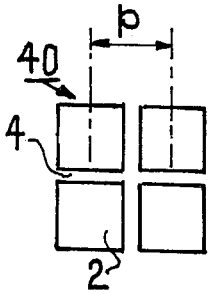

The invention will be better understood by reference to the ensuing description and attached figures where identical references designate identical elements and in which:

FIGS. 1 and 2 are schematic sectional views of two embodiments of an installation wherein is operated the method of the invention; and FIG. 3 is a plan view of a detail of the installation shown in FIG. 1.

For the sake of clarity, in the figures cross-hatching of certain parts has been deliberately omitted.

FIG. 1 is a schematic sectional view of an embodiment of an installation used to achieve the method of the invention, offered by way of non-limitative example. In this figure, the reference 1 designates a chip of a semiconductor material, covered on its rear face with an electrically conductive, transparent layer 3 of tin oxide. In contact with this layer an optical mask 40 is deposited, produced by any known technique and a fragment of which has been shown in plan in FIG. 3. The mask comprises a mosaic of windows 2 at a pitch *p* of 50 microns, formed in a molybdenum deposit 2000 angstrom units in thickness, created upon the layer 3; the reference 4 designates the opaque molybdenum areas which are left behind after the formation of the windows; in the example, the windows 2 in question take the form of squares as FIG. 3 shows.

The chip 1, the layer 3 and the mask 4 constitute the anode assembly of the installation, 11 designating the electrolyte and 5 the cathode which is made of platinum. In the figure, where for reasons of clarity the proportions of the various elements have not been respected, 9 and 10 respectively illustrate the bath containing the electroyte and a seal which ensures fluid-tightness between the bath in question and the semiconductor chip 1. The reference 12 indicates the direct voltage source of the installation, 13 and 14 the connections between this source and respectively the cathode and anode contact 3 of the installation, and 16 a contact-breaker.

The application of voltage Vo between the cathode 5 and the conductor layer 3 of the aforesaid anode assembly, by the closing of the contactbreaker 16, gives rise to the production of a uniform electric field in the chip 1, directed perpendicularly to the faces thereof. High intensity illumination of some few milliwatts per square centimetre within the visible spectrum and the near-infra red, arriving at the side at which the mask 4 is located (undulating arrows at the right of the figure) results in the injection into the chip of holes (circles + signs) by photo-ionisation of the material of the chip. These charge carriers are drained by the electric field E which is directed from right to left, in the manner indicated by the arrow located at the bottom of the element 1. They migrate towards that face of the latter opposite from the one carrying the mask, in the direction of the small arrows, and emerge at said face where, by entraining molecules of the chip, they etch the latter. In the example the chip was of gallium-arsenide with $10^{12}$ free negative charge carriers per cubic centimeter and has a thickness of 200 microns. The voltage V*o* was around 20 volts and field $10^3$ volts/cm. The electrolyte consisted of a basic solution of potassium chromate, $Cr\ O_4\ K_2$. The etching rate, under these conditions, was around 1 micron per minute.

With a sufficient exposure time, the microscopic passages obtained pass from one side of the chip 1 to the other in the manner which is required in a situation where they are designed for electron multiplication. Once removed from the machining system, the chip is then ready for incorporation in electronic devices in the prior art way.

By limiting the exposure time, it is possible on the other hand to obtain blind passages such as those shown at 15 in the Figures.

FIG. 2 illustrates by way of non-limitative example, a schematic sectional view of another installation in which is operated the method of the invention. In this example, the injectors injecting holes into the semiconductor material consist of ohmic contacts. The chip 1 is covered on its right-hand face with a continuous layer 6 of an electrically insulating material certain parts of which are removed by some known method or other in order to form a network of zones 7 in which chip 1 is exposed. These zones are filled up, using some known technique or other, with an electrically conductive material; in this fashion, on the chip a network of ohmic contacts 8 is produced. A conductive layer 30 is applied finally to the assembly of layer 6 and contacts 8. This layer 30 constitues the anode contact of the installation. The application of the voltage from the source 12 between the electrodes 5 and 30 results in the injection of holes into the semiconductor from the contacts 8. These holes are drained by the electric field towards the electrolyte, under conditions similar to those set out in the preceding example.

In the foregoing, we have described the preparation of chips incorporated after removal from the machining installation, into the electronic devices in which they are intended to operate. The same installation, provided that the conditions of injection and hole migration described hereinbefore are adhered to, makes it possible to prepare chips already incorporated into sub-assemblies involved in the make-up of these devices, in particular in a situation where they are intended for electron multiplication applications.

What is claimed is:

1. A method for drilling microscopic passages between two substantially parallel opposite faces of a semiconductor body, utilizing an electrolysis installation comprising: a cathode and an anode in contact with an electrolyte, and mounted between said cathode and said anode a direct voltage source for bringing said anode to a positive potential Vo with respect to said cathode, said method comprising the steps of: forming a semiconductor body with two substantially parallel opposite faces; providing one of said faces with means for creating at said face hole injector points separated from one another and with connection means causing said hole injector points to be in electrical contact with one another; immersing said semiconductor body in said electrolytic solution in such a manner that its other face, opposite said one face, is in contact with said electrolyte; energizing said connection means to the positive terminal of said source; said source being so dimensioned that the positive potential Vo is greater than that potential required to establish in said semiconductor an electric field extending from said one face at least up to a distance from that face in contact with the electrolyte, lesser than the diffusion length of said microscopic passages in said semiconductor.

2. A method as claimed in claim 1, wherein said semiconductor has photoelectric properties; said means for creating said hole injector points consist of an incident photon radiation striking said one face which is covered with a transparent, conductive electrode connected to said positive terminal, and of parts opaque to said radiation applied to said conductive electrode, and of separating windows which are transparent vis-a-vis said radiation.

3. A method as claimed in claim 1, wherein said hole injector points consist of ohmic contacts which are applied to said one face in contact with an electrically conductive electrode connected to said positive terminal, said ohmic contacts being separated from one another by electrically insulating parts.

4. A method as claimed in claim 1, wherein said semiconductor is n-type gallium arsenide with $10^{12}$ free charge carriers per cubic centimeter at the most, and said electrolyte is a basic solution of potassium chromate.

5. A method as claimed in claim 4, wherein said semiconductor is a chip whose thickness between said two faces is of the order of 200 microns, and wherein said voltage V*o* is around 20 volts.

* * * * *